US006425264B1

(12) United States Patent
Wong et al.

(10) Patent No.: US 6,425,264 B1
(45) Date of Patent: Jul. 30, 2002

(54) CRYOGENIC REFRIGERATION SYSTEM

(75) Inventors: Kenneth Kai Wong, Amherst, NY (US); Richard A. Novak, Naperville, IL (US); Michael John Sinicropi, New Milford, CT (US); Dante Patrick Bonaquist, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/930,199

(22) Filed: Aug. 16, 2001

(51) Int. Cl.[7] ..... F25J 1/00
(52) U.S. Cl. ..... 62/613; 62/434; 62/619
(58) Field of Search ..... 62/613, 619, 434

(56) References Cited

U.S. PATENT DOCUMENTS 4,856,285 A 8/1989 Acharya et al. ..... 62/63
5,524,442 A 6/1996 Bergman, Jr. et al. ..... 62/86
5,706,663 A 1/1998 Boiarski et al. ..... 62/114
5,729,993 A 3/1998 Boiarski et al. ..... 62/175
6,067,814 A * 5/2000 Imeland ..... 62/434
6,176,102 B1 1/2001 Novak et al. ..... 62/612
6,250,096 B1 6/2001 Bonaquist et al. ..... 62/401

* cited by examiner

*Primary Examiner*—Ronald Capossela
(74) *Attorney, Agent, or Firm*—Stanley Ktorides

(57) ABSTRACT

A cryogenic refrigeration system wherein refrigeration is provided to a heat load by a warming multicomponent refrigerant fluid recirculating in a refrigeration circuit and by cryogenic liquid separately provided to the heat load in direct or indirect heat exchange with the heat load.

13 Claims, 2 Drawing Sheets

CRYOGENIC REFRIGERATION SYSTEM

TECHNICAL FIELD

This invention relates generally to the provision of refrigeration to a heat load wherein refrigeration is generated and provided to a heat load using a multicomponent refrigerant fluid.

BACKGROUND ART

Refrigeration is used extensively in the freezing of foods, production of pharmaceuticals, liquefaction of natural gas, and in many other applications wherein refrigeration is required to provide cooling duty to a heat load.

A recent significant advancement in the field of refrigeration is the development of refrigeration systems using multicomponent refrigerants which are able to generate refrigeration much more efficiently than conventional systems. These refrigeration systems, also known as mixed gas refrigerant systems or MGR systems, are particularly attractive for providing refrigeration at very low or cryogenic temperatures such as below −80° F.

MGR systems, are typically more costly to install than are conventional vapor compression systems and are more complicated to operate. The high initial cost of an MGR system is particularly disadvantageous when an MGR system is designed to be much larger than nominally required by the specific application in order to be able to meet peak refrigeration requirements. Further costs are incurred to address reliability issues occasioned by the more complex nature of MGR systems.

Accordingly it is an object of this invention to provide a refrigeration system which will enable the use of an MGR system without the need to size the MGR system to meet peak refrigeration requirements of a heat load and without the need to add costly additional reliability systems to the basic MGR system.

SUMMARY OF THE INVENTION

The above and other objects, which will become apparent to those skilled in the art upon a reading of this disclosure, are attained by the present invention, one aspect of which is:

A method for providing refrigeration to a heat load comprising:

(A) compressing a multicomponent refrigerant fluid to provide compressed multicomponent refrigerant fluid, cooling the compressed multicomponent refrigerant fluid to provide cooled compressed multicomponent refrigerant fluid, and expanding the cooled compressed multicomponent refrigerant fluid to provide refrigeration bearing multicomponent refrigerant fluid;

(B) providing refrigeration from the refrigeration bearing multicomponent refrigerant fluid to a heat load and thereafter warming the multicomponent refrigerant fluid by indirect heat exchange with cooling compressed multicomponent refrigerant fluid; and (C) passing cryogenic liquid to the heat load to provide cooling to the heat load.

Another aspect of the invention is:

Apparatus for providing refrigeration comprising:

(A) a heat load;

(B) at least one compressor, an autorefrigerator heat exchanger, an expansion device, and means for passing multicomponent refrigerant fluid from the compressor (s) to the autorefrigerator heat exchanger, from the autorefrigerator heat exchanger to the expansion device, from the expansion device to the heat load and from the heat load to the autorefrigerator heat exchanger; and (C) a cryogenic liquid storage tank and means for passing cryogenic liquid from the cryogenic liquid storage tank to the heat load.

As used herein the term "expansion" means to effect a reduction in pressure.

As used herein the term "expansion device" means apparatus for effecting expansion of a fluid.

As used herein the term "compressor" means apparatus for effecting compression of a fluid.

As used herein the term "multicomponent refrigerant fluid" means a fluid comprising two or more species and capable of generating refrigeration.

As used herein the term "refrigeration" means the capability to reject heat from a subambient temperature system.

As used herein the term "refrigerant fluid" means fluid in a refrigeration process which undergoes changes in temperature, pressure and possibly phase to absorb heat at a lower temperature and reject it at a higher temperature.

As used herein, the term "variable load refrigerant" means a mixture of two or more components in proportions such that the liquid phase of those components undergoes a continuous and increasing temperature change between the bubble point and the dew point of the mixture. The bubble point of the mixture is the temperature, at a given pressure, wherein the mixture is all in the liquid phase but addition of heat will initiate formation of a vapor phase in equilibrium with the liquid phase. The dew point of the mixture is the temperature, at a given pressure, wherein the mixture is all in the vapor phase but extraction of heat will initiate formation of a liquid phase in equilibrium with the vapor phase. Hence, the temperature region between the bubble point and the dew point of the mixture is the region wherein both liquid and vapor phases coexist in equilibrium. In the preferred practice of this invention the temperature differences between the bubble point and the dew point for a variable load refrigerant generally is at least 10° C., preferably at least 20° C., and most preferably at least 50° C.

As used herein the term "heat load" means a stream or object that requires a reduction in energy, or removal of heat, to lower its temperature or to keep its temperature from rising.

As used herein the term "cryogenic liquid" means a liquid comprising at least one of liquid nitrogen, liquid carbon dioxide and liquid argon.

DETAILED DESCRIPTION

Figure 1:
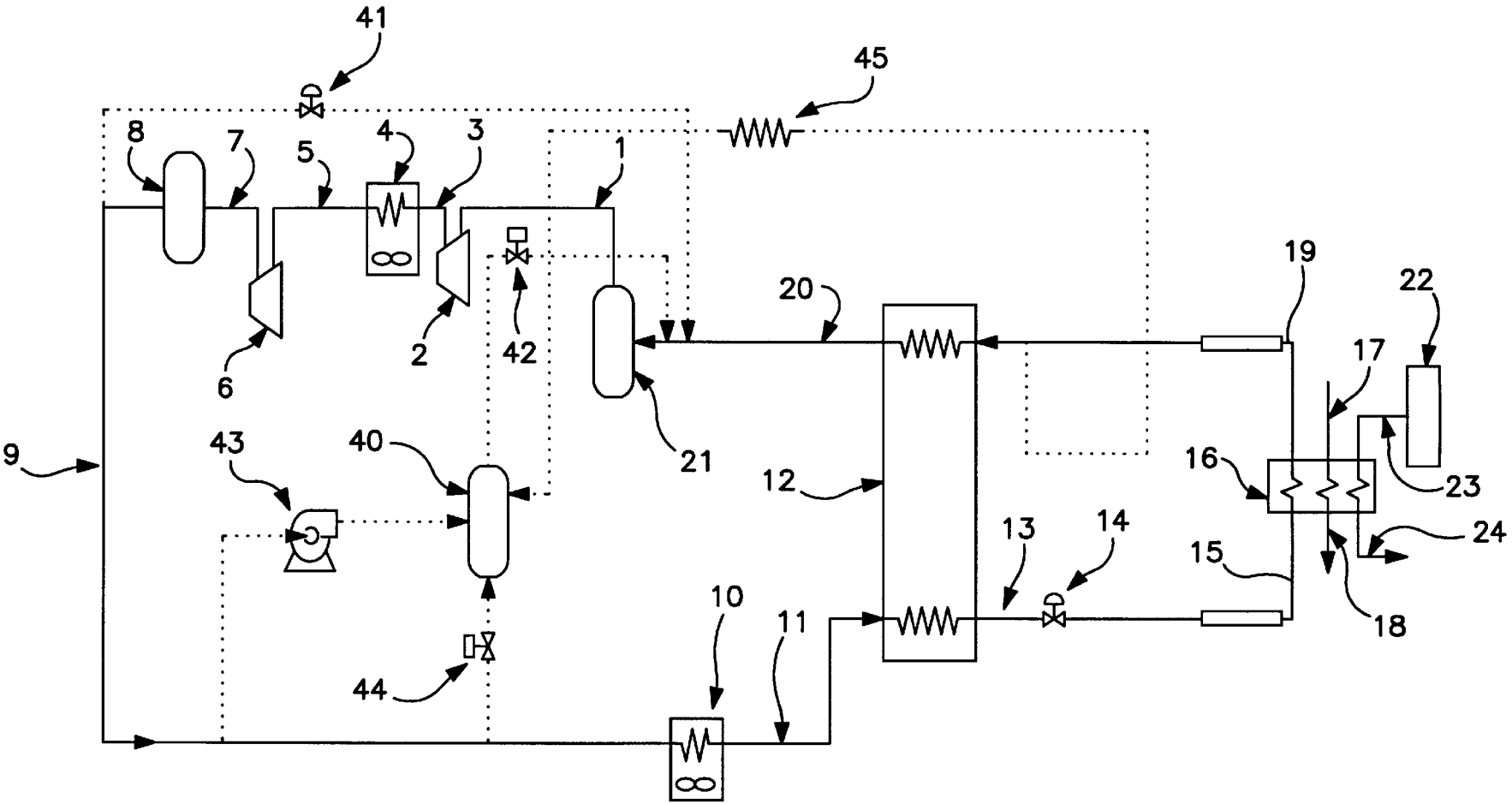
FIG. 1 is a schematic representation of one preferred embodiment of the cryogenic refrigeration system of this invention.

The invention will be described in detail with reference to the Drawings. Referring now to FIG. 1, multicomponent refrigerant fluid 1 is passed to first compressor or compression stage 2 wherein it is compressed to a pressure generally within the range of from 40 to 250 pounds per square inch absolute (psia). Compressed multicomponent refrigerant fluid 3 is cooled by passage through air cooled intercooler 4 and resulting multicomponent refrigerant fluid 5 is passed to subsequent compressor or compression stage 6 wherein it is further compressed to a pressure generally within the range of from 80 to 500 psia to provide compressed multicomponent refrigerant fluid 7. Compressed multicomponent refrigerant fluid 7 is cleaned of oil contaminants by passage through oil filter 8 and resulting compressed multicomponent refrigerant fluid 9 is cooled of the heat of compression by passage through air cooled desuperheater 10. Resulting compressed multicomponent refrigerant fluid 11 is then passed to autorefrigerator heat exchanger 12.

The multicomponent refrigerant fluid used in the practice of this invention preferably comprises at least two species from the group consisting of fluorocarbons, hydrofluorocarbons, hydrochlorofluorocarbons, fluoroethers, atmospheric gases and hydrocarbons, e.g. the multicomponent refrigerant fluid could be comprised only of two fluorocarbons. Preferably the multicomponent refrigerant useful in the practice of this invention is a variable load refrigerant.

One preferred multicomponent refrigerant useful with this invention preferably comprises at least one component from the group consisting of fluorocarbons, hydrofluorocarbons, and fluoroethers, and at least one component from the group consisting of fluorocarbons, hydrofluorocarbons, hydrochlorofluorocarbons, fluoroethers, atmospheric gases and hydrocarbons.

In one preferred embodiment of the invention the multicomponent refrigerant consists solely of fluorocarbons. In another preferred embodiment of the invention the multicomponent refrigerant consists solely of fluorocarbons and hydrofluorocarbons. In another preferred embodiment of the invention the multicomponent refrigerant consists solely of fluorocarbons, fluoroethers and atmospheric gases. Most preferably every component of the multicomponent refrigerant is either a fluorocarbon, hydrofluorocarbon, fluoroether or atmospheric gas.

Within autorefrigerator heat exchanger 12 the compressed multicomponent refrigerant fluid is cooled by indirect heat exchange with warming multicomponent refrigerant fluid as will be more fully described below. Cooled compressed multicomponent refrigerant fluid 13 is passed from autorefrigerator heat exchanger 12 to expansion device 14 wherein it is expanded to generate refrigeration. Preferably, the expansion device is a Joule-Thomson valve and the expansion is isenthalpic expansion. Refrigeration bearing multicomponent refrigerant fluid 15, which preferably is partly or totally in the liquid phase, is then passed to a heat load to provide refrigeration to the heat load.

In the embodiment of the invention illustrated in FIG. 1 the heat load is a food freezer wherein refrigeration from the multicomponent refrigerant fluid is passed into the atmosphere of the food freezer. Other heat loads which may receive refrigeration by use of the cryogenic refrigeration system of this invention include reactors for the chemical process industry, freeze drying, biostorage, superconductivity, telecommunications, liquefaction of natural gas, medical imaging, as well as other food freezing arrangements.

Referring back now to FIG. 1, refrigeration bearing multicomponent refrigerant fluid 15 is passed to food freezer 16 wherein it provides refrigeration to the heat load by indirect heat exchange with the atmosphere of food freezer 16. Typically at least some of the multicomponent refrigerant fluid is vaporized in the course of providing refrigeration to the heat load. In the embodiment illustrated in FIG. 1 the food freezer atmosphere is provided to food freezer 16 by means of intake 17 and removed from food freezer 16 by means of exhaust 18.

Multicomponent refrigerant fluid is passed in stream 19 from the heat load to autorefrigerator heat exchanger 12 wherein it is warmed, and any remaining liquid fluid vaporized, by indirect heat exchange with the cooling compressed multicomponent refrigerant fluid 11. Resulting warmed multicomponent refrigerant fluid 20 is passed to accumulator 21 where any remaining liquid, if any, is removed, and then gaseous multicomponent refrigerant fluid is passed from accumulator 21 to compressor 2 as stream 1 and the multicomponent refrigerant fluid refrigeration cycle starts anew.

Cryogenic liquid is stored in cryogenic liquid storage tank 22. The preferred cryogenic liquid is liquid nitrogen. Cryogenic liquid is passed in stream 23 from storage tank 22 to heat load 16 wherein the cryogenic liquid is warmed and preferably vaporized to provide cooling to the heat load. The passage of the cryogenic liquid to the heat load can take place during and/or prior to and/or subsequent to the provision of refrigeration from the refrigeration bearing multicomponent refrigerant fluid to the heat load. When it is provided to the heat load during the provision of refrigeration from the multicomponent refrigerant fluid, it is preferably provided only during a portion of this period, i.e. during periods of peak refrigeration demand. In the embodiment of the invention illustrated in FIG. 1 the cryogenic liquid provides cooling to the heat load by indirect heat exchange. The warmed and preferably vaporized cryogenic fluid is removed from heat load 16 in vent stream 24.

FIG. 1 also illustrates a preferred arrangement wherein a surge tank 40 is used to provide a surge volume so that the system high side pressure and low side pressure can be maintained at their setpoints. This surge tank system is shown using dotted lines. For example, if the high side pressure becomes too high, fluid is passed to surge tank 40 from the compressor discharge through valve 41. If the high side pressure is too low, fluid is passed from surge tank 40 into the circuit upstream of the compressor suction through valve 42. The surge tank also serves as a refrigerant holding volume if any part of the system or the entire system needs to be isolated. In this case fluid is provided to the surge tank through one or more of pump 43, valve 44 and vaporizer 45.

Figure 2:
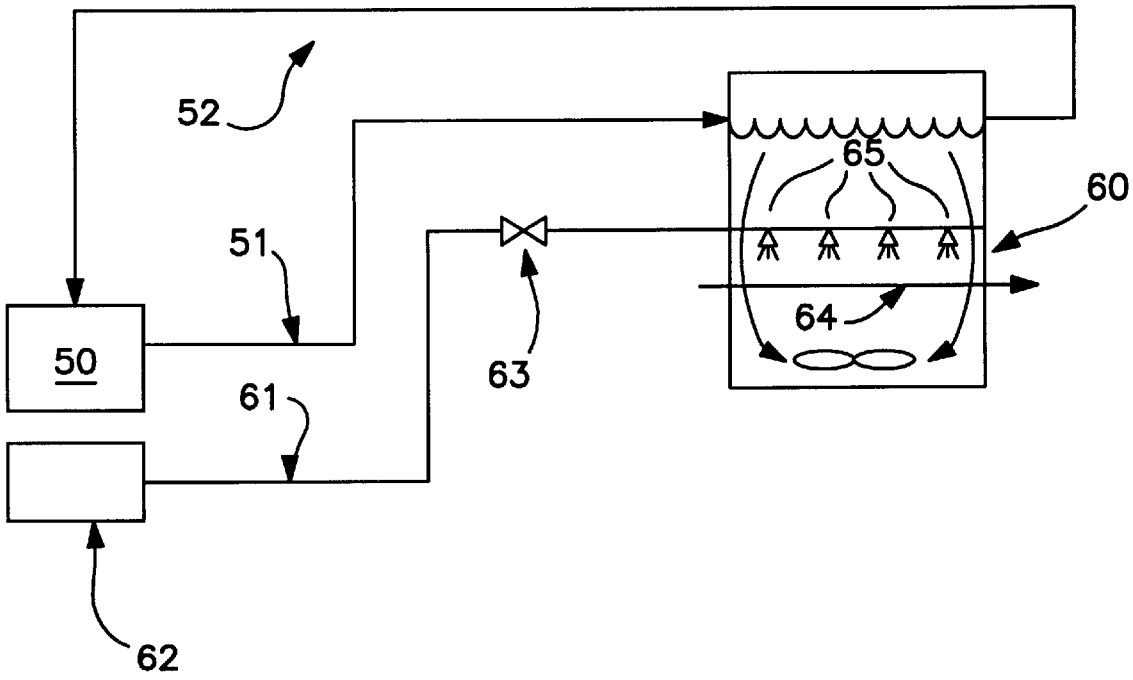
FIG. 2 is a simplified schematic representation of another preferred embodiment of the cryogenic refrigeration system of this invention.

FIG. 2 illustrates another embodiment of the invention wherein the cryogenic liquid provides cooling to the heat load by direct heat exchange. In the embodiment of the invention illustrated in FIG. 2, the multicomponent refrigerant fluid refrigeration circuit operates in a manner substantially the same as that described with FIG. 1 and thus the description will not be repeated. It is shown in FIG. 2 in representative fashion as box 50 with outgoing leg 51 to heat load 60 and incoming leg 52 from heat load 60.

Referring now to FIG. 2, cryogenic liquid 61 from cryogenic liquid storage tank 62 is passed through valve 63 to heat load 60 which in the embodiment of the invention illustrated in FIG. 2 is a food freezer. Food, e.g. hamburger patties, is passed through food freezer 60 such as on a conveyor belt as shown in representational form by arrow 64. Within food freezer 60 the cryogenic liquid, e.g. liquid nitrogen, is sprayed from sprayer heads 65 onto the food thereby cooling and freezing the food or maintaining the food in a frozen condition. The resulting vaporized cryogenic liquid is then vented from the food freezer.

Although the invention has been described in detail with reference to certain preferred embodiments, those skilled in the art will recognize that there are other embodiments of the invention within the spirit and the scope of the claims.

What is claimed is:

1. A method for providing refrigeration to a heat load comprising:

(A) compressing a multicomponent refrigerant fluid to provide compressed multicomponent refrigerant fluid, cooling the compressed multicomponent refrigerant fluid to provide cooled compressed multicomponent refrigerant fluid, and expanding the cooled compressed multicomponent refrigerant fluid to provide refrigeration bearing multicomponent refrigerant fluid;

(B) providing refrigeration from the refrigeration bearing multicomponent refrigerant fluid to a heat load and thereafter warming the multicomponent refrigerant fluid by indirect heat exchange with cooling compressed multicomponent refrigerant fluid; and (C) passing cryogenic liquid to the heat load to provide cooling to the heat load.

2. The method of claim 1 wherein the cryogenic liquid is passed to the heat load to provide cooling to the heat load during at least a portion of the time that refrigeration from the refrigeration bearing multicomponent refrigerant fluid is being provided to the heat load.

3. The method of claim 2 wherein the cryogenic liquid is passed to the heat load to provide cooling to the heat load during only a portion of the time that refrigeration from the refrigeration bearing multicomponent refrigerant fluid is being provided to the heat load.

4. The method of claim 1 wherein the cryogenic liquid provides cooling to the heat load by indirect heat exchange.

5. The method of claim 1 wherein the cryogenic liquid provides cooling to the heat load by direct heat exchange.

6. The method of claim 1 wherein the heat load comprises food.

7. The method of claim 1 wherein the cryogenic liquid comprises liquid nitrogen.

8. The method of claim 1 wherein the multicomponent refrigerant fluid comprises at least two species from the group consisting of fluorocarbons, hydrof luorocarbons, hydrochlorofluorocarbons, fluoroethers, atmospheric gases and hydrocarbons.

9. The method of claim 1 wherein the multicomponent refrigerant fluid is a variable load refrigerant.

10. The method of claim 1 wherein the expansion of the cooled compressed multicomponent refrigerant fluid is an isenthalpic expansion.

11. Apparatus for providing refrigeration comprising:

(A) a heat load;

(B) at least one compressor, an autorefrigerator heat exchanger, an expansion device, and means for passing multicomponent refrigerant fluid from the compressor (s) to the autorefrigerator heat exchanger, from the autorefrigerator heat exchanger to the expansion device, from the expansion device to the heat load and from the heat load to the autorefrigerator heat exchanger; and (C) a cryogenic liquid storage tank and means for passing cryogenic liquid from the cryogenic liquid storage tank to the heat load.

12. The apparatus of claim 11 wherein the heat load comprises a food freezer.

13. The apparatus of claim 11 wherein the compressor comprises an initial stage and a subsequent stage with an intercooler between the initial stage and the subsequent stage.

* * * * *